US009525947B2

(12) United States Patent
Liu et al.

(10) Patent No.: US 9,525,947 B2
(45) Date of Patent: Dec. 20, 2016

(54) PIEZOELECTRIC LOUDSPEAKER

(71) Applicant: Miezo Inc., New Taipei (TW)

(72) Inventors: Yuan-Ping Liu, Taipei (TW); Chang-Heng Tsai, Changhua (TW); Kai-Wen Cheng, Taipei (TW); Chung-chun Ho, Taichung (TW)

(73) Assignee: MIEZO INC., New Taipei (TW)

( * ) Notice: Subject to any disclaimer, the term of this patent is extended or adjusted under 35 U.S.C. 154(b) by 348 days.

(21) Appl. No.: 14/164,417

(22) Filed: Jan. 27, 2014

(65) Prior Publication Data

US 2015/0092963 A1 Apr. 2, 2015

(30) Foreign Application Priority Data

Oct. 2, 2013 (TW) ..... 102135767 A

(51) Int. Cl.

*H04R 25/00* (2006.01)
*H04R 17/10* (2006.01)
*H04R 1/28* (2006.01)

(52) U.S. Cl.

CPC ..... *H04R 17/10* (2013.01); *H04R 1/288* (2013.01); *H04R 1/2819* (2013.01); *H04R 1/2888* (2013.01); *H04R 2201/021* (2013.01)

(58) Field of Classification Search

CPC ..... H04R 17/10; H04R 17/00; H04R 1/345; H04R 1/2884; H04R 1/2819; H04R 1/288; H04R 1/2888; H04R 2201/021; G10K 2210/32272

See application file for complete search history.

(56) References Cited

U.S. PATENT DOCUMENTS 2,713,396 A * 7/1955 Tavares ..... H04R 1/2834 181/163
3,423,543 A * 1/1969 Kompanek ..... G01B 5/207 381/152
3,970,879 A * 7/1976 Kumon ..... G10K 9/122 310/324
4,029,170 A * 6/1977 Phillips ..... H04R 1/20 181/148
4,278,851 A * 7/1981 Takaya ..... G10K 9/122 310/322

(Continued)

*Primary Examiner* — Matthew Eason
*Assistant Examiner* — Taunya McCarty
(74) *Attorney, Agent, or Firm* — Muncy, Geissler, Olds & Lowe, P.C.

(57) ABSTRACT

The present invention discloses a piezoelectric loudspeaker. The piezoelectric loudspeaker comprises a sound producing plate, a resonant sound-box, a surround and a reflective sound-box. The sound producing plate comprises a piezoelectric ceramic element. The resonant sound-box includes a first opening comprising a first carrying part. The sound producing plate is disposed on the first carrying part. A cavity resonator is formed between the sound producing plate and the resonant sound-box. The surround is disposed between the first carrying part and the sound producing plate. The reflective sound-box includes a second opening and a reflective output opening. The second opening comprises a second carrying part. The resonant sound-box is disposed on the second carrying part. A reflective cavity body is formed between the resonant sound-box and the reflective sound-box, and the reflective cavity body is connected the reflective output opening.

10 Claims, 7 Drawing Sheets

(56) References Cited

U.S. PATENT DOCUMENTS

| | | | | | |
|---|---|---|---|---|---|
| 4,413,198 | A * | 11/1983 | Bost | G10K 11/08 | 310/322 |
| 4,597,099 | A * | 6/1986 | Sawafuji | H04R 17/00 | 310/313 D |
| 5,073,946 | A * | 12/1991 | Satoh | H04R 1/2834 | 181/145 |
| 5,204,501 | A * | 4/1993 | Tsao | H04R 1/2834 | 181/156 |
| 5,749,433 | A * | 5/1998 | Jackson | H04R 1/2834 | 181/156 |
| 5,784,340 | A * | 7/1998 | Kanai | H04R 17/00 | 310/322 |
| 2012/0170786 | A1* | 7/2012 | Yu | H04R 17/00 | 381/370 |

* cited by examiner

PIEZOELECTRIC LOUDSPEAKER

CROSS-REFERENCE TO RELATED APPLICATION

This application claims the benefit of Taiwan Application No. 102135767, filed on Oct. 2, 2013, in the Taiwan intellectual Property Office, the disclosure of which is incorporated herein its entirety by reference.

BACKGROUND OF THE INVENTION

1. Field of the Invention

The present invention generally relates to a piezoelectric loudspeaker, in particular with respect to a piezoelectric loudspeaker with effects upon damping, soundproofing, and to increase the low frequency amplitude through the audio reflection so as to improve the sound quality.

2. Description of the Related Art

In view of the known piezoelectric loudspeaker does not use magnet and voice coil, but only needs a membrane to produce sound, so that the operation of energy conversion becomes simpler. More specifically, the process of producing sound for the general loudspeaker is to convert the electricity into magnetic energy and then into mechanical energy, however, the piezoelectric loudspeaker produces sound by means of converting electricity into mechanical vibration directly, which has advantage of promoting the efficiency of producing sound.

Even though the piezoelectric loudspeaker gets rid of the innate defect of distortion caused by permanent magnet and voice coil, but the fly in the ointment is that the piezoelectric loudspeaker is incapable of having higher amplitude, resulting in the current piezoelectric loudspeaker is merely applicable in the range of high frequency.

SUMMARY OF THE INVENTION in view of the above problems, one of objectives of the present invention is to provide a piezoelectric loudspeaker so as to overcome the obstacles to the known piezoelectric loudspeaker.

The present invention provides a piezoelectric loudspeaker, comprising a sound producing plate, a resonant sound-box, a surround and a reflective sound-box. The sound producing plate includes at least one piezoelectric ceramic element which can vibrate the sound producing plate. The resonant sound-box includes a first opening, a first carrying part is disposed in an inner edge of the first opening, the sound producing plate is disposed on the first carrying part, and a cavity resonator is formed between the sound producing plate and the resonant sound-box. A surround is disposed between the first carrying part and the sound producing plate. A reflective sound-box includes a second opening and a reflective output opening, a second carrying part is formed on a partial inner edge of the second opening, the resonant sound-box is disposed on the second carrying part, a reflective cavity body is formed between the resonant sound-box and the reflective sound-box, the reflective output opening is located on a side of the reflective sound-box, and the reflective cavity body is connected the reflective output opening.

Preferably, the piezoelectric loudspeaker further comprises a circuit board which is disposed in the cavity resonator, and transmits an actuating signal to at least one piezoelectric ceramic element so as to vibrate the at least one piezoelectric ceramic element.

Preferably, the piezoelectric loudspeaker further comprises at least one damping unit which is disposed on a surface opposite to the second opening of the reflective sound-box.

Preferably, a surface opposite to the second opening of the reflective sound-box and detachably connected to a preset surface of an object.

Preferably, at least one piezoelectric ceramic element is disposed on the sound producing plate and located in the cavity resonator.

Perfectly, at least one piezoelectric ceramic element is disposed on a surface opposite to the cavity resonator of the sound producing plate.

Preferably, when the resonant sound-box is disposed on the second carrying part, an exposed part of the second opening adjacent to a side of the resonant sound-box is the reflective output opening.

Perfectly, the surround comprises a plurality of holes.

Preferably, the damping coefficient of the surround is higher than which of the sound producing plate.

Preferably, the sound producing plate is composed of paper, wood, phenolic resins, polyethylene, polyethylene terephthalate or the combination thereof.

From the above said, the conclusion can be reached that the piezoelectric loudspeaker of the present application enables the sound producing plate being disposed closely on the first carrying part by the surround, so as to form a closed cavity resonator between the sound producing plate and the resonant sound-box; in addition, the surround also has a similar damping function and can reduce the vibration caused by the reflective sound-box and the resonant sound-box while the sound producing plate is sounding as well as to absorb the impact when the piezoelectric loudspeaker is hit; furthermore, the reflective cavity body and the exposed part of the second opening connect with each other to form a reflective channel, and the sound will increase the low frequency amplitude after being reflected through the reflective cavity body and the reflective channel, then being output by the exposed part of the second opening.

DETAILED DESCRIPTION OF THE PREFERRED EMBODIMENTS

Hereinafter, embodiments of the present invention will be described in detail with reference to the accompanying drawings so that those skilled in the art to which the present invention pertains can realize the present invention. As those skilled in the art would realize, the described embodiments may be modified in various different ways, all without departing from the spirit or scope of the present invention.

Figure 1:
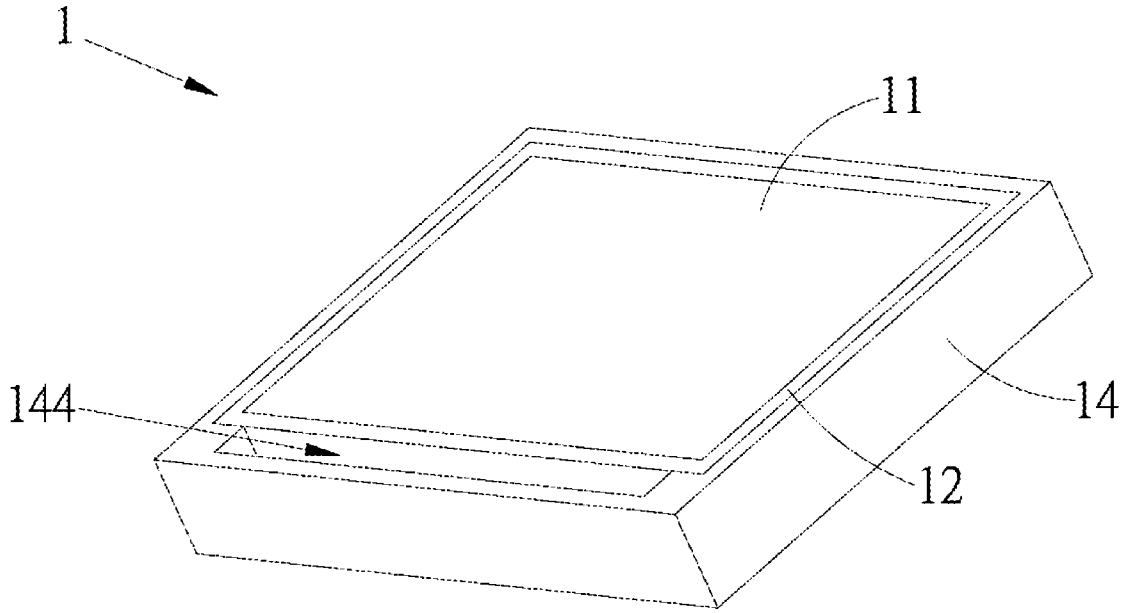
FIG. 1 is an assembly view of a piezoelectric loudspeaker according to an embodiment of the present invention.
Figure 2:
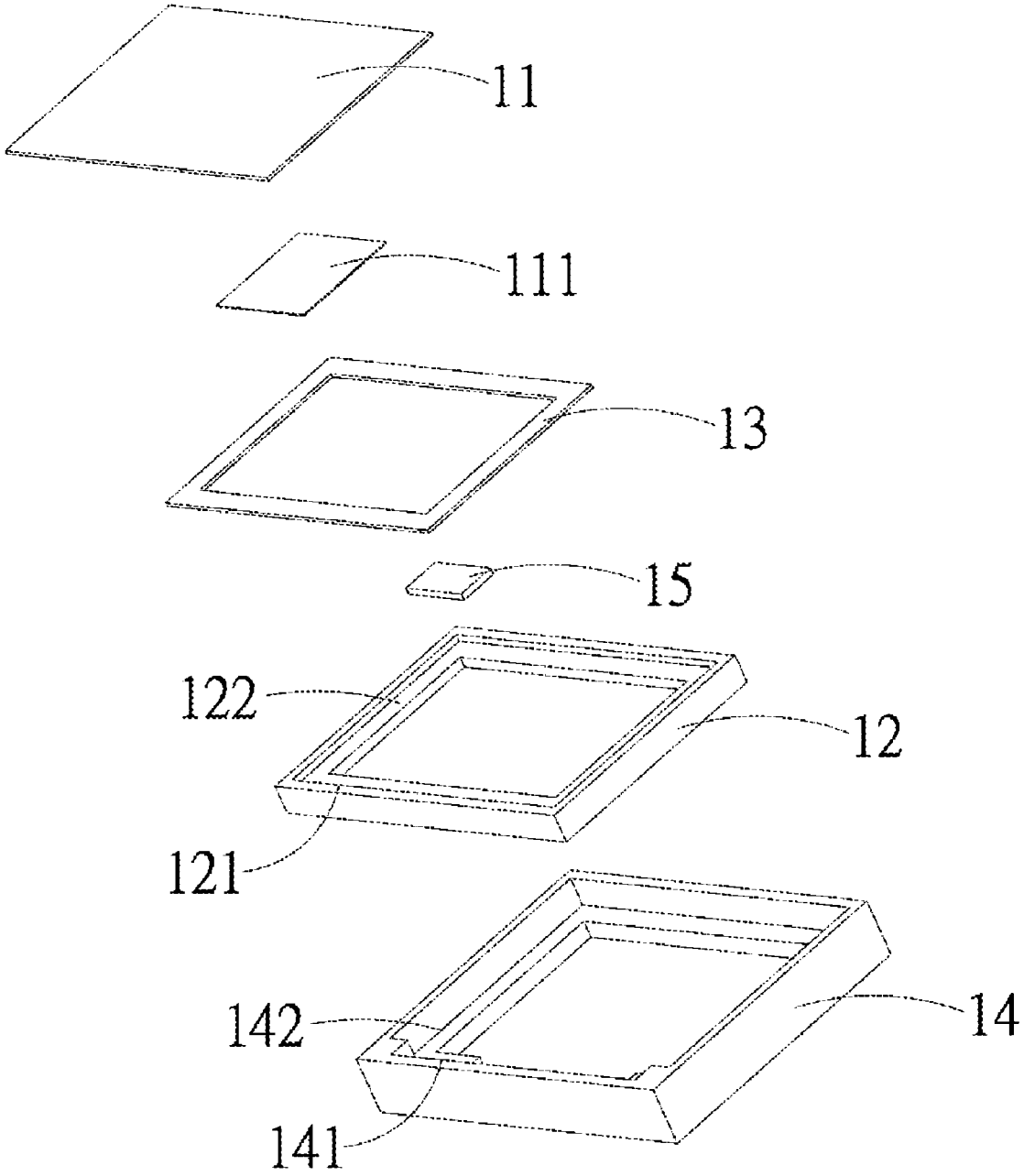
FIG. 2 is a breakdown view of a piezoelectric loudspeaker according to an embodiment of the present invention.
Figure 3:
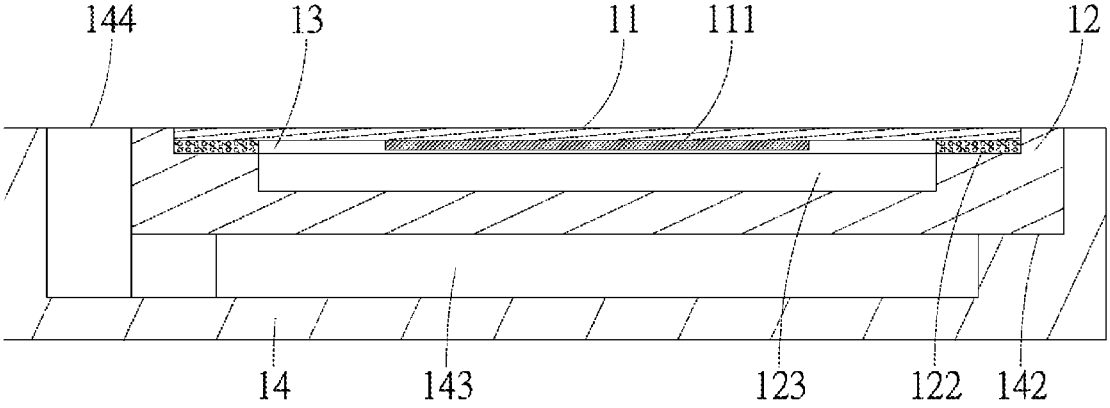
FIG. 3 is a first sectional view of a piezoelectric loudspeaker according to an embodiment of the present invention.
Figure 4:
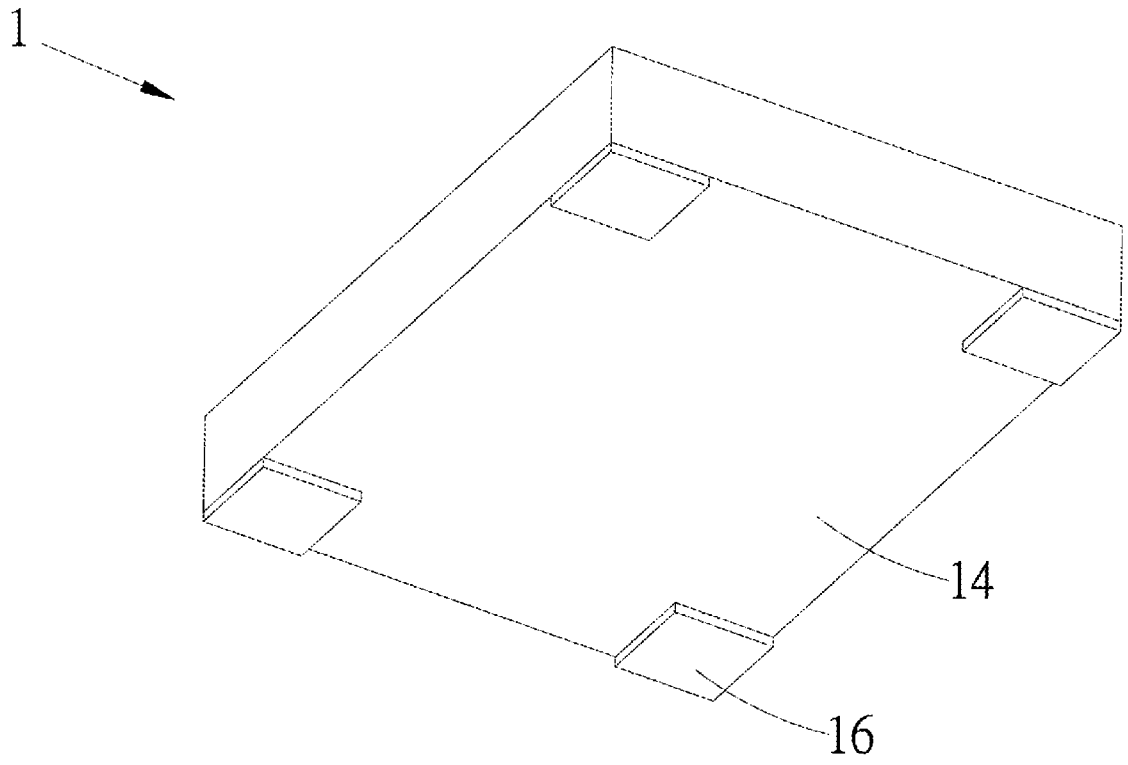
FIG. 4 is a schematic view of a piezoelectric loudspeaker according to an embodiment of the present invention.
Figure 5:
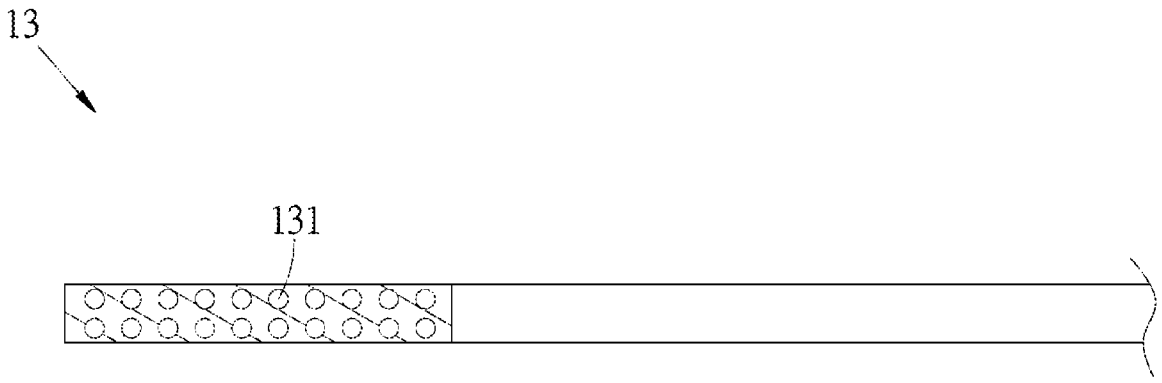
FIG. 5 is a sectional view of a surround of a piezoelectric loudspeaker according to an embodiment of the present invention.
Figure 6:
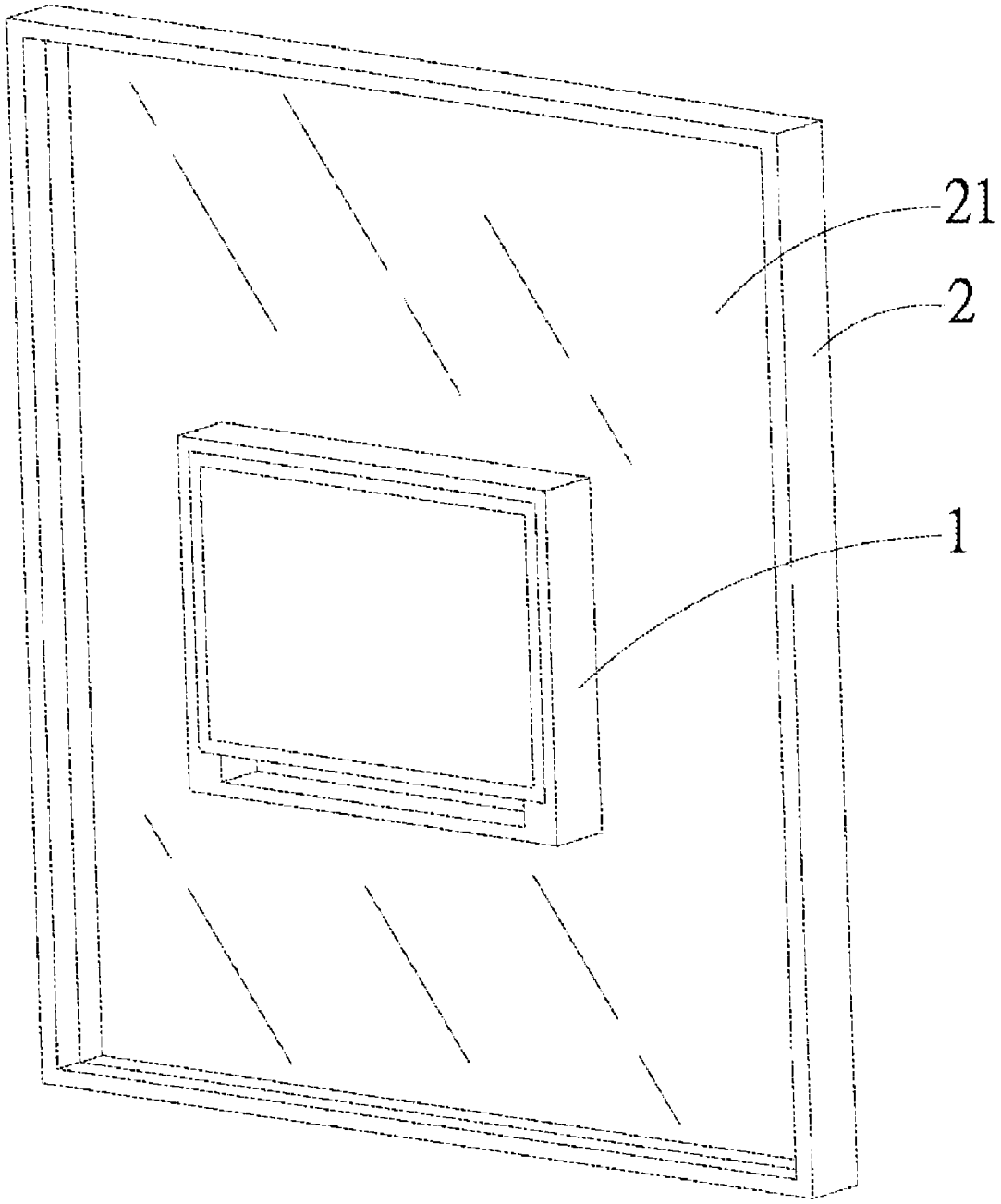
FIG. 6 is a practical application view of a piezoelectric loudspeaker according to an embodiment of the present invention.

With reference to FIGS. 1 to 6; FIG. 1 is an assembly view of a piezoelectric loudspeaker according to an embodiment of the present invention; FIG. 2 is a breakdown view of a piezoelectric loudspeaker according to an embodiment of the present invention; FIG. 3 is a first sectional view of a piezoelectric loudspeaker according to an embodiment of the present invention; FIG. 4 is a schematic view of a piezoelectric loudspeaker according to an embodiment of the present invention; FIG. 5 is a sectional view of a surround of a piezoelectric loudspeaker according to an embodiment of the present invention; FIG. 6 is a practical application view of a piezoelectric loudspeaker according to an embodiment of the present invention. As can be seen in the FIGS., the piezoelectric loudspeaker 1 of the present application comprises a sound producing plate 11, a resonant sound-box 12, a surround 13 and a reflective sound-box 14.

Wherein, the sound producing plate 11 is composed of paper, wood, phenolic resins, polyethylene (PE), polyethylene terephthalate (PET) or the combination thereof, but shall not be subject to this restriction. The sound producing plate 11 includes at least one piezoelectric ceramic element 111 which can vibrate the sound producing plate 11. The resonant sound-box 12 includes a first opening 121, a first carrying part 122 is disposed in an inner edge of the first opening 121, the sound producing plate 11 is disposed on the first carrying part 122, and a cavity resonator 123 is formed between the sound producing plate 11 and the resonant sound-box 12; wherein, the cavity resonator 123 shall be a cavity body with airtight effect, but shall not subject to this restriction against the structure thereof. A surround 13 is disposed between the first carrying part 122 and the sound producing plate 11. A reflective sound-box 14 includes a second opening 141 and a reflective output opening 144, a second carrying part 142 is formed on a partial inner edge of the second opening 141, the resonant sound-box 12 is disposed on the second carrying part 142, a reflective cavity body 143 is formed between the resonant sound-box 12 and the reflective sound-box 14, the reflective output opening 144 is located on a side of the reflective sound-box 14, and the reflective cavity body 143 is connected the reflective output opening 144; in other words, the reflective sound-box 14 has function of increasing the reflective path of sound, and in the present embodiment, it shall not subject to this restriction against the shape of the reflective cavity body 143.

In accordance with the foregoing description, it does not restrict to the location where the piezoelectric ceramic element 111 is disposed on the sound producing plate 11. For example, the piezoelectric ceramic element 111 may be disposed on a surface of the sound producing plate 11 and located in the cavity resonator 123, or disposed on another surface opposite to the cavity resonator 123 of the sound producing plate 11, however, the aforementioned description is an example and shall not subject to this restriction against the arrangement of the piezoelectric ceramic element 111.

In addition, the piezoelectric loudspeaker 1 further comprises a circuit board 15 which is disposed in the cavity resonator 123, but the specific location thereof shall not subject to this restriction; and the circuit board 15 transmits an actuating signal to the piezoelectric ceramic element 111 so as to vibrate the piezoelectric ceramic element 111 as well as the sound producing plate 11 to further produce sound.

The surround 13 of the present invention has a similar characteristic of damping, so it can provide effect upon damping, soundproofing, and is composed of rubber, silicone, foaming material, spring, magnet, steel or other elastic materials, more preferably, the damping coefficient of the surround 13 is higher than which of the sound producing plate 11. In the present embodiment, the surround 13 is disposed on the first carrying part 122, and when the sound producing plate 11 connects with the resonant sound-box 12, the sound producing plate 11 connects to the first carrying part 122 closely through the surround 13, in other words, the surround 13, which is disposed between the sound producing plate 11 and the resonant sound-box 12, makes the sound producing plate 11 connects to the resonant sound-box 12 closely.

Preferably, the surround 13 includes a plurality of holes 131, that is, the surround 13 is composed of porous material. In the process of producing sound of the sound producing plate 11, by means of the surround 13, which has a characteristic of holes 131, to perform effect upon damping and soundproofing, so as to reduce the vibration of the piezoelectric loudspeaker 1 caused by the sound producing plate 11 and avoid the voice quality being affected. On the other hand, when the piezoelectric loudspeaker 1 is hit, the surround 13 has the characteristic of absorbing the vibration to reduce the risk of damage to the piezoelectric loudspeaker 1 and the component thereof.

In view of the foregoing description of the surround 13, the piezoelectric loudspeaker 1 can further dispose at least one damping unit 16 on a surface opposite to the second opening 141 of the reflective sound-box 14; as the name implies, damping unit 16 is disposed between the piezoelectric loudspeaker 1 and a plane where the piezoelectric loudspeaker 1 is placed for being a buffer layer between the piezoelectric loudspeaker 1 and the plane. Therefore, when the piezoelectric loudspeaker 1 vibrates on the plane in the process of producing sound, the damping unit 16 can avoid the vibration, so as to reduce the sound caused by the vibration between the piezoelectric loudspeaker 1 and the plane to maintain the voice quality of the piezoelectric loudspeaker 1.

Furthermore, the piezoelectric loudspeaker 1 of the present invention is detachably disposed on an object 2. Take a window as an example of the object 2, the piezoelectric loudspeaker 1 is connected on a preset surface 21 of the object 2 through a surface opposite to the second opening 141 of the reflective sound-box 14, and take the glass as an example of the preset surface 21, the surface of the reflective sound-box 14 can directly connect on the preset surface 21, and can also dispose at least connection unit (e.g. sucker, not shown in the FIGS., but shall not subject to this restriction) on the surface of the reflective sound-box 14, and to connect on the preset surface 21 through the connection unit. The aforementioned movement cannot merely place the piezoelectric loudspeaker 1 in a presser location so as to vibrate with the preset surface 21 in the process of producing sound, but also produce different sounding effect from which purely produces by the piezoelectric loudspeaker 1.

In addition, the reflective output opening 144 can be formed by an exposed part of the second opening 141 adjacent to a side of the resonant sound-box 12 when the resonant sound-box 12 is disposed on the second carrying part 142, and after the sound caused by vibration is reflected through the reflective cavity body 143 and the channel between the reflective cavity body 143 and the reflective output opening 144, being output by the reflective output opening 144.

Figure 7:
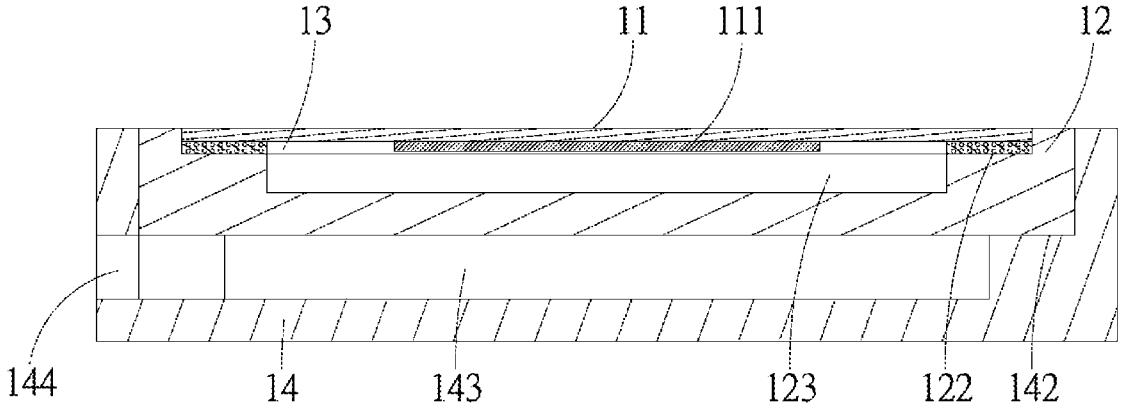
FIG. 7 is a second sectional view of a piezoelectric loudspeaker according to an embodiment of the present invention.

In addition, with reference to FIG. 7 for a second sectional view of a piezoelectric loudspeaker according to an embodiment of the present invention, as can be seen in FIG. 7, the reflective output opening 144 cannot only be formed by the exposed part of the second opening 141, but also disposed on a side of the reflective sound-box 14, and connected to the reflective cavity body 143.

In practical operation, it should note that deciding whether the circuit board 15 outputs an actuating signal to the piezoelectric ceramic element 111 in accordance with whether the switch turns on or the power is supplied, and because the relevant technology with respect to switch or power supply terminal (e.g. plug) belongs to the ordinary knowledge towards a person in the art, hence, it does not being demonstrated in the drawings, and will not to give unnecessary details in the present embodiment.

To sum up, the piezoelectric loudspeaker of the present invention can dispose the surround between the first carrying part and the sound producing plate to connect the sound producing plate on the first carrying part closely, and a closed cavity resonator is formed between the sound producing plate and the resonant sound-box; on the other hand, the surround can also reduce the vibration caused by the reflective sound-box and the resonant sound-box while the sound producing plate is producing sound as well as absorb the impact while being hit. In addition, the reflective cavity body and the exposed part of the second opening are connected with each other so as to form reflective channel and to further prolong the reflective path of the reflective sound through the reflective cavity body and the reflective channel, and after the sound is reflected through the reflective cavity body and the reflective channel, the wavelength increases so that the low frequency amplitude is thus increased, and being output by the exposed part of the second opening.

While the means of specific embodiments in present invention has been described by reference drawings, numerous modifications and variations could be made thereto by those skilled in the art without departing from the scope and spirit of the invention set forth in the claims. The modifications and variations should in a range limited by the specification of the present invention.

What is claimed is:

1. A piezoelectric loudspeaker, comprising:

a sound producing plate including at least one piezoelectric ceramic element being able to vibrate the sound producing plate;

a resonant sound-box including a first opening comprising a first carrying part, the first carrying part being disposed in an inner edge of the first opening, the sound producing plate being disposed on the first carrying part, and a cavity resonator being formed between the sound producing plate and the resonant sound-box;

a surround disposed between the first carrying part and the sound producing plate; and a reflective sound-box including a second opening and a reflective output opening, a second carrying part formed on a partial of an inner edge of the second opening, the resonant sound-box being disposed on the second carrying part, a reflective cavity body being formed between the resonant sound-box and the reflective sound-box, the reflective output opening being disposed on a side of the reflective sound-box, and the reflective cavity body being communicating with the reflective output opening.

2. The piezoelectric loudspeaker of claim 1, further comprising a circuit board disposed in the cavity resonator, and transmitting an actuating signal to the at least one piezoelectric ceramic element so as to vibrate the at least one piezoelectric ceramic element.

3. The piezoelectric loudspeaker of claim 1, further comprising at least one damping unit disposed on a surface opposite to the second opening of the reflective sound-box.

4. The piezoelectric loudspeaker of claim 1, wherein a surface opposite to the second opening of the reflective sound-box is detachably connected to a preset surface of an object.

5. The piezoelectric loudspeaker of claim 1, wherein the at least one piezoelectric ceramic element is disposed on the sound producing plate and located in the cavity resonator.

6. The piezoelectric loudspeaker of claim 1, wherein the at least one piezoelectric ceramic element is disposed on a surface opposite to the cavity resonator of the sound producing plate.

7. The piezoelectric loudspeaker of claim 1, wherein when the resonant sound-box is disposed on the second carrying part, an exposed part of the second opening adjacent to a side of the resonant sound-box is the reflective output opening.

8. The piezoelectric loudspeaker of claim 1, wherein the surround comprises a plurality of holes.

9. The piezoelectric loudspeaker of claim 1, wherein a damping coefficient of the surround is higher than a damping coefficient of the sound producing plate.

10. The piezoelectric loudspeaker of claim 1, wherein the sound producing plate is composed of paper, wood, phenolic resins, polyethylene, polyethylene terephthalate or the combination thereof.

* * * * *